US006088980A

United States Patent [19]

Gulliver

[11] Patent Number: 6,088,980

[45] Date of Patent: Jul. 18, 2000

[54] SPACE DIVIDER SYSTEM

[75] Inventor: Barron J. Gulliver, Elkhart, Ind.

[73] Assignee: L & P Property Management Company, South Gate, Calif.

[21] Appl. No.: 09/047,784

[22] Filed: Mar. 25, 1998

Related U.S. Application Data

[60] Provisional application No. 60/068,779, Dec. 24, 1997.

[51] Int. Cl.[7] ..... E04H 1/06

[52] U.S. Cl. ..... 52/239; 52/582.1; 52/582.2; 52/240; 403/293; 403/294

[58] Field of Search ..... 52/582.1, 582.2, 52/239, 240; 403/293, 294, 292, 334, 336, 335

[56] References Cited

U.S. PATENT DOCUMENTS

| | | | |
|---|---|---|---|
| Re. 32,890 | 3/1989 | DeFouw et al. | 52/239 |
| 3,037,593 | 6/1962 | Webster . | |
| 3,282,006 | 11/1966 | Halsey et al. . | |
| 3,430,997 | 3/1969 | Propst et al. | 52/239 |
| 4,443,986 | 4/1984 | Propst et al. | 52/239 |
| 4,567,698 | 2/1986 | Morrison | 52/239 X |
| 4,625,483 | 12/1986 | Zacky et al. | 52/239 |
| 5,058,347 | 10/1991 | Schuelke et al. | 52/239 |
| 5,117,599 | 6/1992 | Voss | 52/239 X |
| 5,134,826 | 8/1992 | La Roche et al. | 52/584.1 |
| 5,187,908 | 2/1993 | Losensky | 52/582.1 X |
| 5,211,502 | 5/1993 | Upham-Hill | 52/239 X |
| 5,274,970 | 1/1994 | Roberts | 52/239 X |
| 5,592,794 | 1/1997 | Tundaun | 52/582.1 X |

FOREIGN PATENT DOCUMENTS

| | | |
|---|---|---|
| 2 435 572 | 4/1980 | France . |
| 2 640 659 | 6/1990 | France . |

*Primary Examiner*—Carl D. Friedman
*Assistant Examiner*—Phi Dieu Tran A
*Attorney, Agent, or Firm*—Baker & Daniels

[57] ABSTRACT

Space divider system includes multiple interconnected panel members and post members to form free-standing walls to subdivide an area. A pair of vertically extending rails are mounted on the vertical edges of a pair of panels to be joined together. Upper and lower connectors are used to interconnect the ends of the rails. The lower connector is mounted on one of the panels and extends into the rail of the other panel, thereby aligning the panels vertically. The upper connector comprises a pair of vertically tapering legs interconnected by a connecting portion through which a screw fastener extends into a bracket mounted on one of the edges. Accordingly, by tightening the screw, the upper connector may be tightened toward the lower connector, and, because of the tapered legs, the rails of the members are drawn together while maintaining vertical and lateral alignment, thus providing a secure and stable connection with a relatively narrow gap that must be covered by trim.

17 Claims, 8 Drawing Sheets

SPACE DIVIDER SYSTEM

This application claims benefit of provisional application Ser. No. 60/068,779 Dec. 12, 1997.

This application relates to a Space Divider System having multiple interconnected panels to form free-standing walls to subdivide an area.

The Space Divider Systems are commonly used to subdivide office space into working areas. These systems may be arranged and rearranged as necessary to provide flexibility in use of office areas. However, many existing space divider systems are relatively difficult to install in that they require separate standards which are installed between units. Others require multiple types of connecting hardware to attach panels to each other or to the standards in all of the required configurations. The panels also are sometimes difficult to align, often requiring skilled workmen to efficiently install and take apart the systems. Furthermore, it is also desirable for the intersection between panels to be as narrow as possible, so that unattractive slot used for attaching components may be covered by an attractive trim strip which also should be pre-assembled. Furthermore, prior art systems require different hardware for installing panels in different configurations, thus complicating both field stocking requirements and increasing difficulty of installation. In systems requiring a standard between the panels, alignment and stability become problems if installers are inexperienced.

According to the present invention, any configuration of panels can be easily assembled if the installers are familiar with two basic joining methods (panel to panel or post, and transition panel to panel), and have available four simple pieces of connecting hardware. Accordingly, installation is simplified over prior art methods, because prior art methods generally require different hardware for different configurations. No standard or other intermediate member is used in the present invention; accordingly, the gap between the panels is minimized, and the present invention makes panels inherently self-aligning. The invention uses slotted rails which are attached to the vertical edges of the panels and/or post, and the installation hardware consists of top and bottom connector brackets which attach to the panels through the same screws that attach the rails to the panels. The bottom connector includes a groove that extends around the bottom edges of the rails and into a pocket defined between the members of the rail. Accordingly, during installation, the bottom connector is loosely fitted into the bottom of the joining panel rail, thus approximately aligning the top ends of the rails of both panels. A tapering top connector is fitted into the adjoining pockets of both side rails, and a screw is installed through the top connector, and into a top connector bracket. When tightened, the two side rails are forced into vertical alignment with one another and the vertical rails are also drawn into intimate contact with each other. Similarly, when a panel is joined to a post, a unit post anchor is installed on the corresponding side of the post, which includes a rail shaped similarly to the rails installed on the edges of the panels. If the post and the panel are the same height, the same connecting hardware is used that is used to connect panels of the same height. Transition panels at a lesser height may be attached to a post by simply relocating the upper post anchor to the appropriate height. Transition panels of a lesser height may be joined either to the other panels or to a post through a upper transition connector, the bottom connector being the same in all cases. Accordingly, only four pieces of simple installation hardware are necessary, and the different configurations are formed by two different installation techniques.

These and other advantages of the invention will become apparent from the following description, with reference to the accompanying drawings, in which FIG. 1 is view in perspective of a typical arrangement of panels forming a space divider system made pursuant to the teachings of the present invention;

Figure 1:
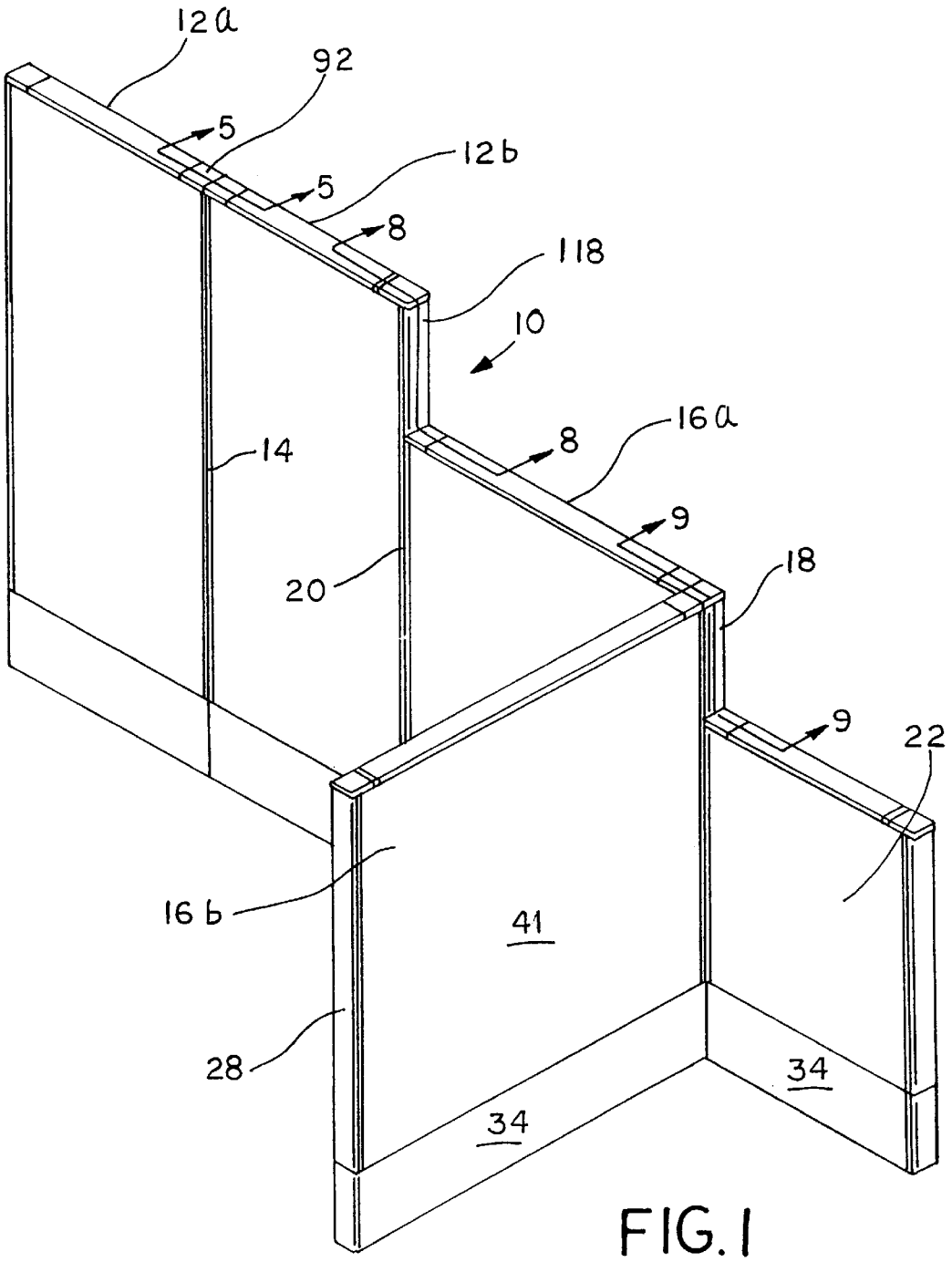

Referring now to the drawings, a space divider system generally indicated by the numeral 10 includes panels 12*a,* and 12*b* which are joined together along a juncture 14 by use of the present invention. In addition to the panels 12*a,* 12*b,* panels 16*a,* 16*b* of a lesser height are joined together at substantially right angles with respect to one another at post 18. Panel 16*a* is joined to panel 12*b* at juncture 20. Panel 22, of a still lesser height as compared to panel 16*a* and 16*b,* is joined to the side of the post 18 opposite the side adjoining panel 16*a*. Each of the panels 12, 16, and 22 consist of an wood perimeter frame 24 which may also be made of metal or other suitable material and which is filled with a preferably sound-deadening core material 26. Decorative trim strips 28 cover the exposed edges of the frame 24 in a manner well-known to those skilled in the art. The panels are supported by conventional height support feet 30 which are attached to the bottom edges of the frame 24, and are provided with height adjustors 32. The feet 30 are covered by a trim panel 34. Appropriate fasteners, such as screws 36, are used to attach the feet to the frame, and similar screw fasteners 38 are used to attach brackets 40 to the frame 24 to which the trim strips 28 are secured to the frame 24. A cloth covering 41 is stretched over the frame thus covering, the frame and core material 26. The covering 41, trim strips 28, frame 24 and feet 30 are all conventional items well-known to those skilled in the art.

Figure 2:
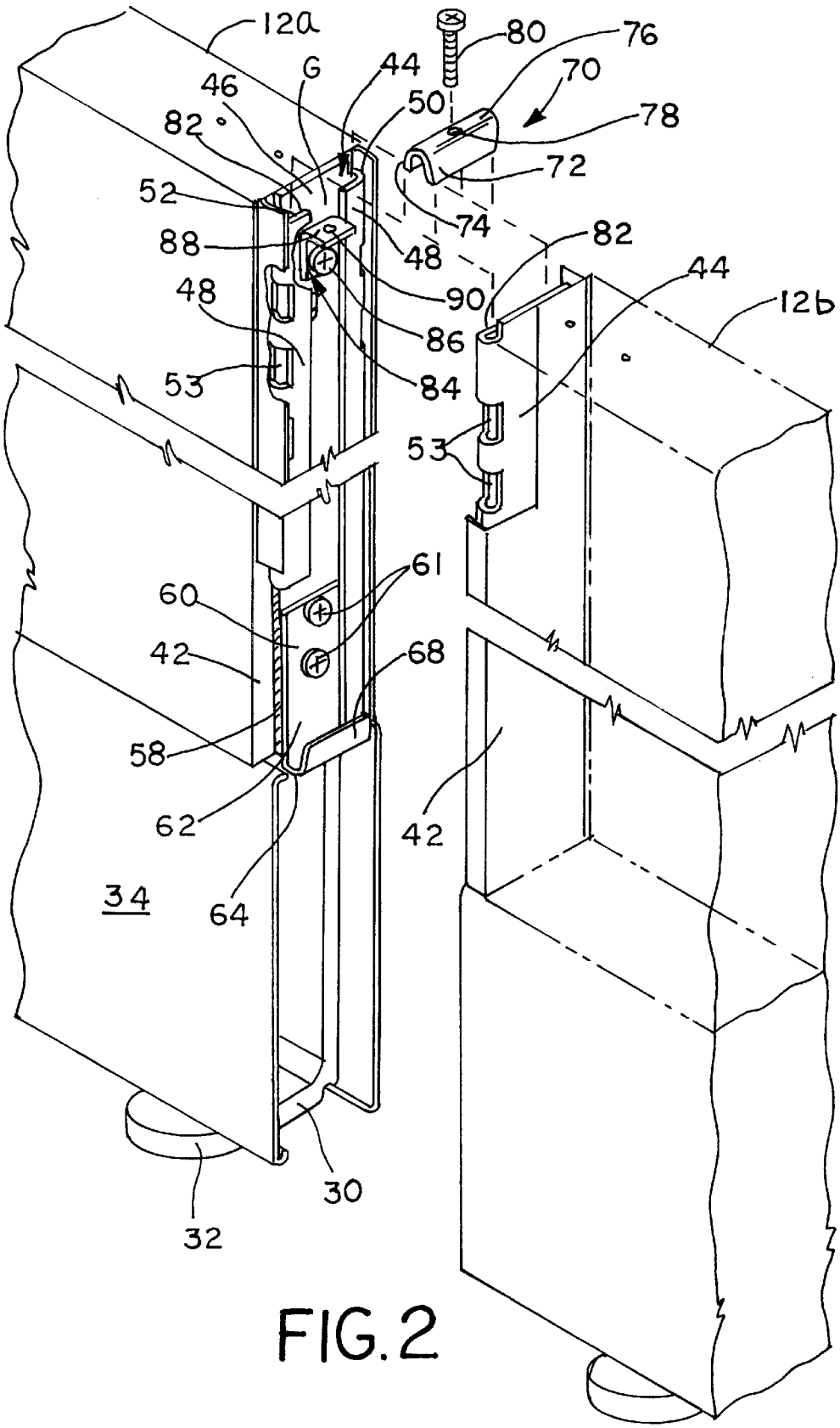
FIG. 2 is an exploded, fragmentary view in perspective illustrating the manner in which two panels of substantially the same height are joined together using the teachings of the present invention.
Figure 6:
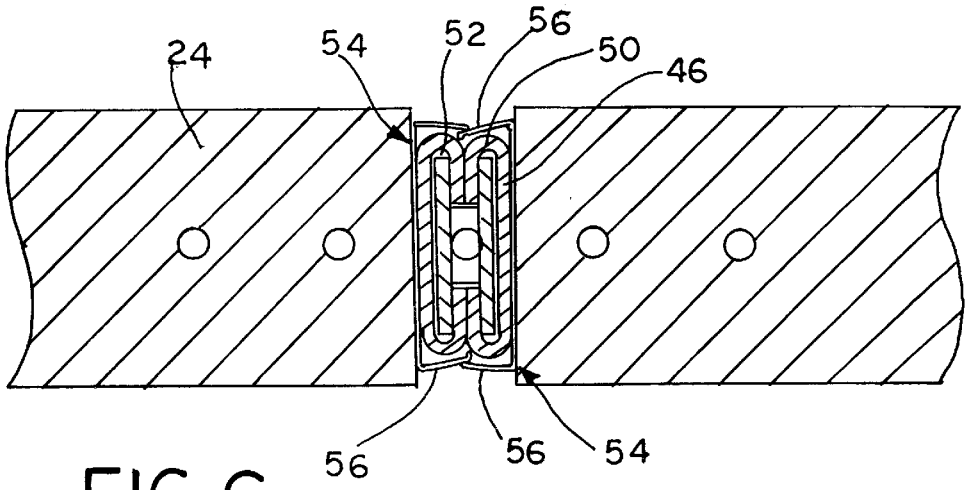
FIG. 6 is a fragmentary, cross-sectional view taken substantially along lines 6—6 of FIG. 5.
Figure 7:
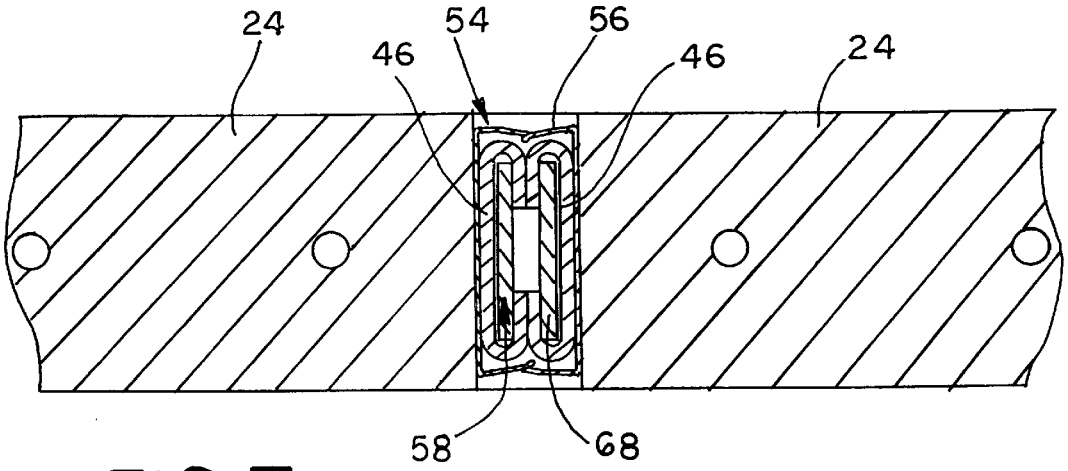
FIG. 7 is a fragmentary, cross-sectional view taken substantially along lines 7—7 of FIG. 5.

Turning now to FIG. 2, which illustrates the manner in which the panels 12*a* and 12*b* are joined together at the juncture 14, each of the panels 12*a,* 12*b* include a vertical edge 42 which faces the vertical edge 42 of the other panel. A vertically extending slotted rail member generally indicated by the numeral 44 is secured to the edges 42. Each rail member 44 includes a substantially flat base plate 46, from which flanges 48 extend, the flanges being connected to the base plate 48 by curved edges 50 to define a pocket 52 between the flanges 48, the edges 50, and the base plate 46. Slots 53 are spaced apart along the edges 50 to permit easy installation of work station componentry. The slots 53 may be labeled with identifying letters or numbers to facilitate installation of componentry in the same slots of rails on opposite ends of the panels. Trim strips as best illustrated in FIGS. 6 and 7, and generally indicated by the numeral 54, include outwardly-projecting flexible arm portions 56, which are sufficiently long that they engage the arm portions 56 carried by the trim strip 54 on the other edge, thus concealing the rails 44 after the panels are joined together as will hereinafter be explained. The arms 56 may be easily deflected to permit access to the slots 53.

As illustrated in FIG. 2, the lower part of one of the flanges 48 on panel 12*a* has been sectioned away to reveal in more detail a lower connector generally indicated by the numeral 58. Lower connector 58 includes a tang 60 which lies within the pocket 52 and extends substantially between the side edges 50. Fasteners, such as screws 61, extend through the tang 60 and the rail 44 and the trim strip 54 to secure all the latter unto the side edge 42. Lower connector 58 further includes a tapering portion 62 which tapers outwardly toward the flanges 48 and a hook 64 which extends under the lower edge 66 of the flanges 48. When the panel 12*a* is attached to the panel 12*b,* the hook 64 extends beneath both of the lower end 66 of the flanges 48 of the rails 44 installed on both panels 12*a* and 12*b*. The lower connector 60 terminates in a tab 68 which extends into the pocket 52 of the rail 44 mounted on the edge of the panel 12*b*. Since the hook 64 extends beneath the lower edge 66 of the flanges on both the panel 12*a* and the panel 12*b,* the flanges attached to both panels are maintained in substantial alignment, particularly since the edges of the tab 68 cooperate with the edges 50 to locate the panels laterally relative to one another, while the engagement of the hook 64 with the bottom edge of 66 of the flanges orient the flanges, and therefore the panels 12*a* and 12*b,* in a vertical alignment with one another. Accordingly, the tab 68, the hook 64, and the portion 62 of the lower connector 60 define a generally upwardly facing groove which receives the ends 66 of the flanges 48 on both of the panels 12*a* and 12*b*. It will be noted that tab 68 tapers slightly outwardly from the hook 64, and thus the tab 68, the hook 64, and the portion 62 form a groove with tapered sides which receives the flanges 48 on both the panels 12*a* and 12*b* to draw them into tight arrangement.

Figure 5:
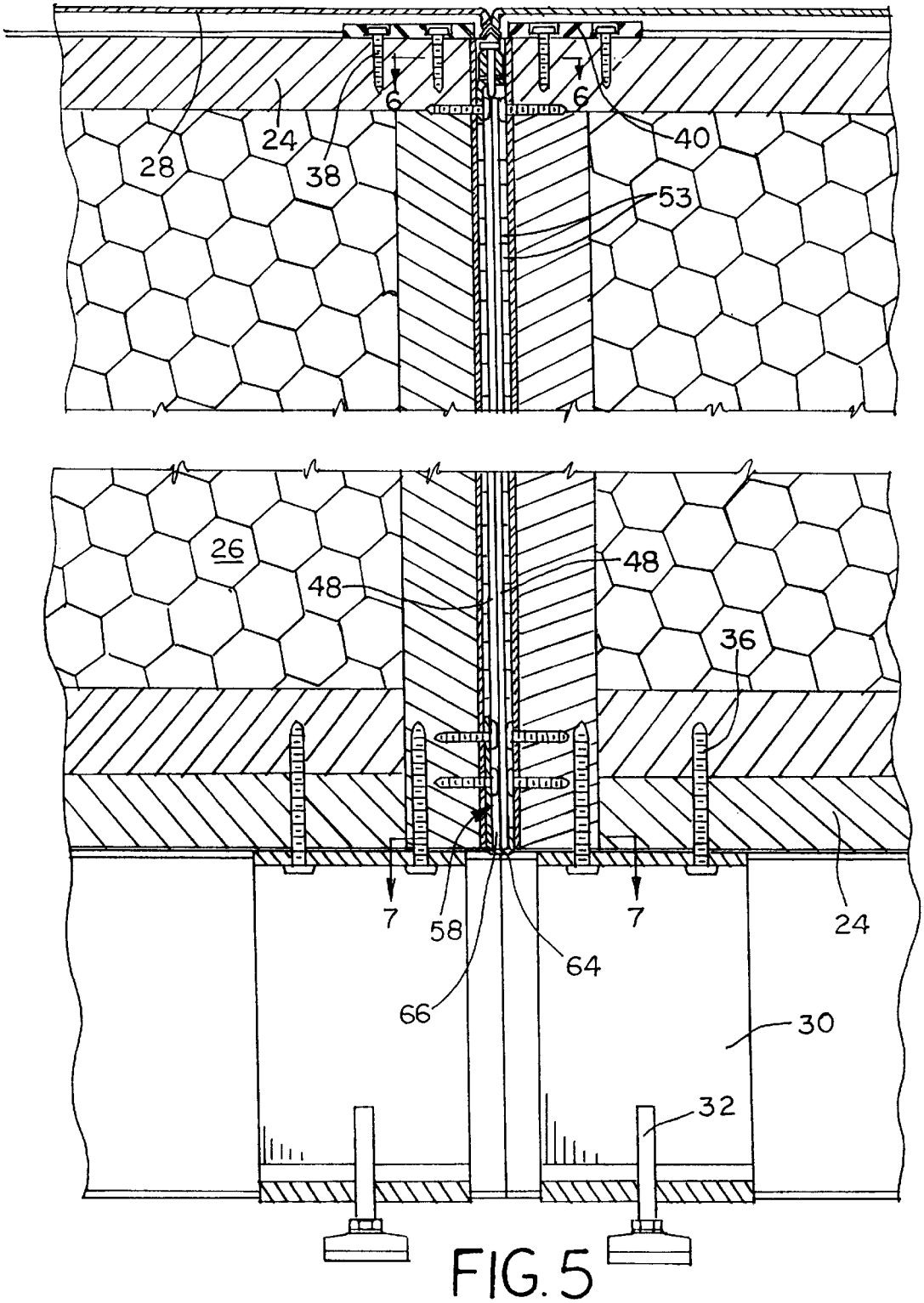
FIG. 5 is a fragmentary, cross-sectional view taken substantially along lines 5—5 of FIG. 1.

The panels 12*a* and 12*b* are also held in place by an upper connector generally indicated by the numeral 70. Upper connector 70 includes a pair of downwardly diverging legs 72, 74 which diverge outwardly from a connecting or bridging portion 76 which is provided with an aperture 78 for receiving screw fastener 80. Accordingly, the legs 72, 74 and the connecting portion 76 form a downwardly facing groove with vertically diverging legs. The upper ends 82 of the rail flanges 48 are received within the groove defined by the legs 72, 74 when the panels 12*a* and 12*b* are joined together, as most clearly illustrated in FIG. 5. An L-shaped bracket 84 is installed within the cavity 52 on the rail 44 carried by the panel 12*a* and is secured in place by fastener 86 which extends through the bracket 84, the rail 44, and the trim 54 to secure all of them to the panel 12*a*. The upper leg 88 of the bracket 84 projects through the gap G defined between the ends of the flanges 48 of the rail 44 installed on panel 12*a* and may be received in the corresponding gap G on the rail 44 installed on the panel 12*b*. A threaded aperture 90 is formed in the leg 88 to receive the screw 80.

When panel 12*a* is to be joined to panel 12*b,* the lower end 66 of the flanges 48 of the rail carried by panel 12*b* is installed in the groove defined by the hook 64 on lower connector 60. It will be understood that only one of the panels carries the lower connector 60 and the L-shaped bracket 84, in this case panel 12*a*.

Accordingly, once the lower end of the rail is received within the groove defined by the hook 64 on the lower connector 58, the rails on the panels 12*a,* 12*b* are in rough vertical alignment. The leg 74 of the upper connector 70 is then installed in the pocket defined by the rail 44 on panel 12*a,* with the connecting portion 76 extending over the upper edges 82 of the flanges. At the same time, the leg 72 is installed in the pocket defined on the rail 44 carried by the panel 12*b*. The connecting portion 76 thus extends over the upper ends 82 of both of the rails. The fastener 80 is then inserted through the aperture 78 and is threadedly connected in the aperture 90. Accordingly, the screw fastener 80 may be tightened, thereby drawing the upper connector 70 downwardly toward the lower connector 78. Because of the tapering of the leg 72, 74, as the connector 70 is forced downwardly, the flanges 48 of the rails installed on both the panels 12*a* and 12*b* are drawn tightly against one another, thus eliminating any discontinuities due to minor variations in the materials. Appropriate trim strips 92 can then be installed over the top of the gap between the panels 12*a* and 12*b,* with the arms 56 of trim strips 54 concealing the sides of the rails.

Figure 3:
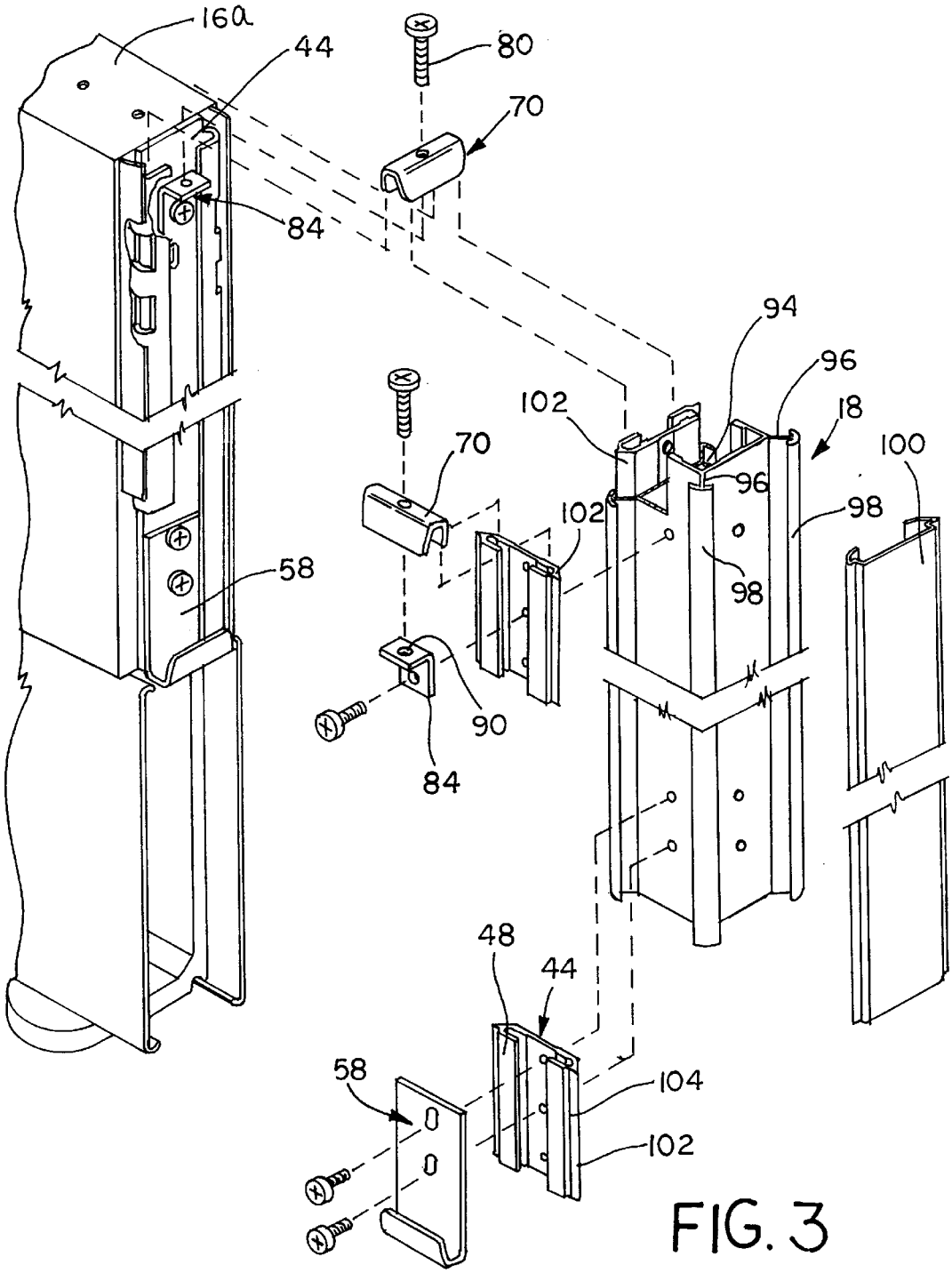
FIG. 3 is a view similar to FIG. 2, but illustrating the manner in which panels of substantially the same height may be joined to a post using the teachings of the present invention.
Figure 4:
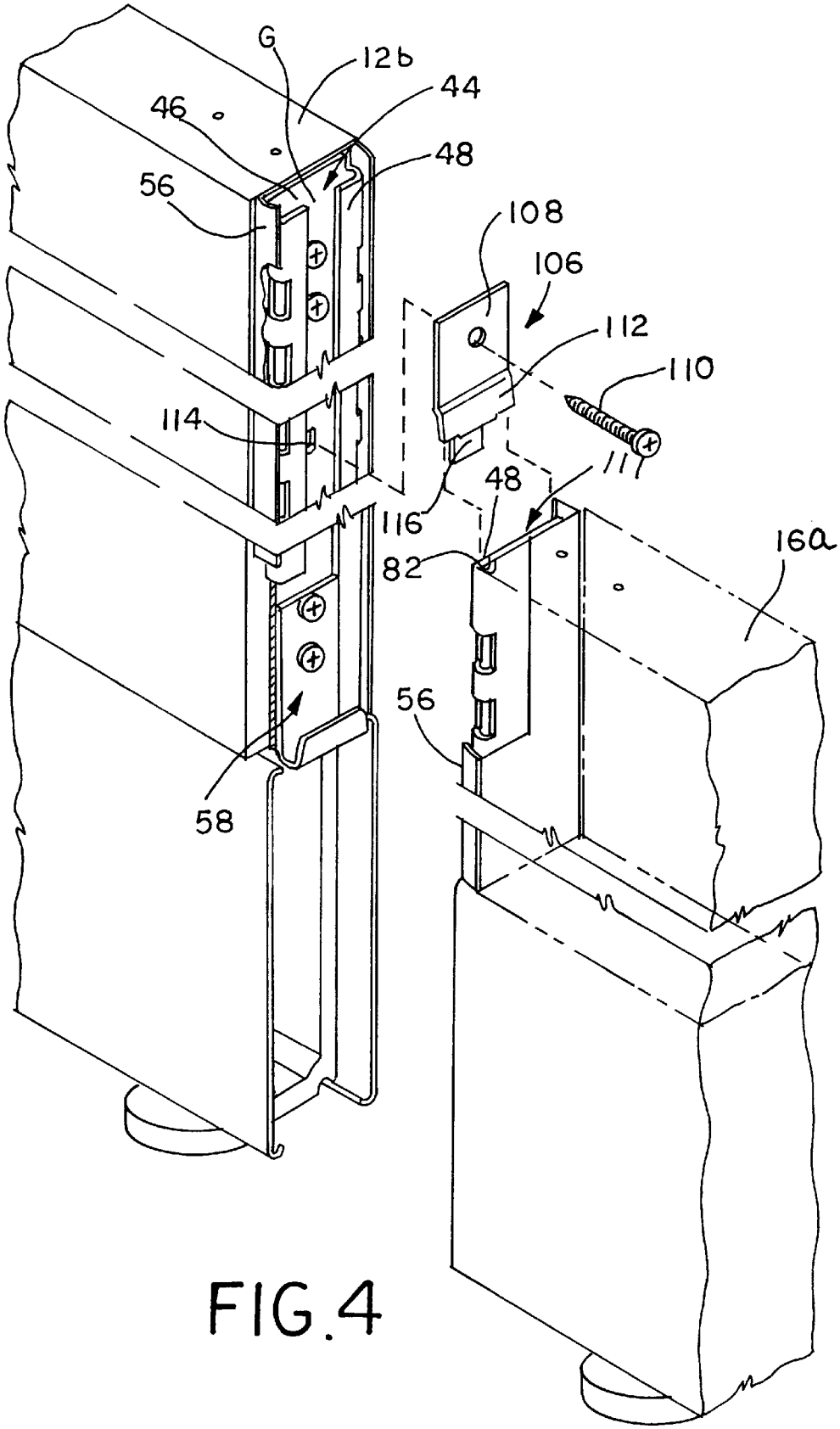
FIG. 4 is a view similar to FIGS. 2 and 3, but illustrating the manner in which a transition panel of a lesser height is joined to a panel of greater height using the techniques of the present invention.
Figure 8:
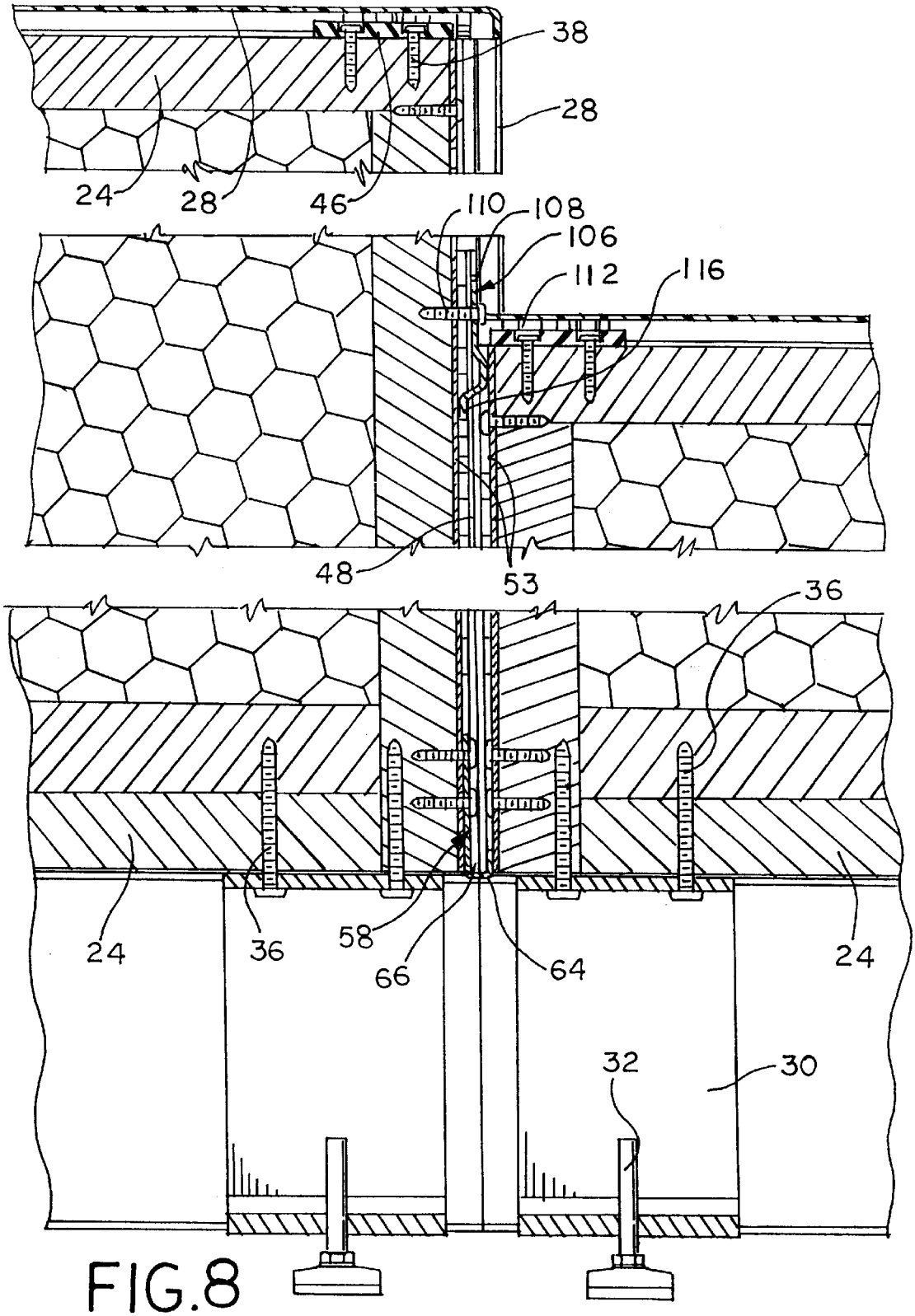
FIG. 8 is a fragmentary, cross-sectional view taken substantially along lines 8—8 of FIG. 1.
Figure 9:
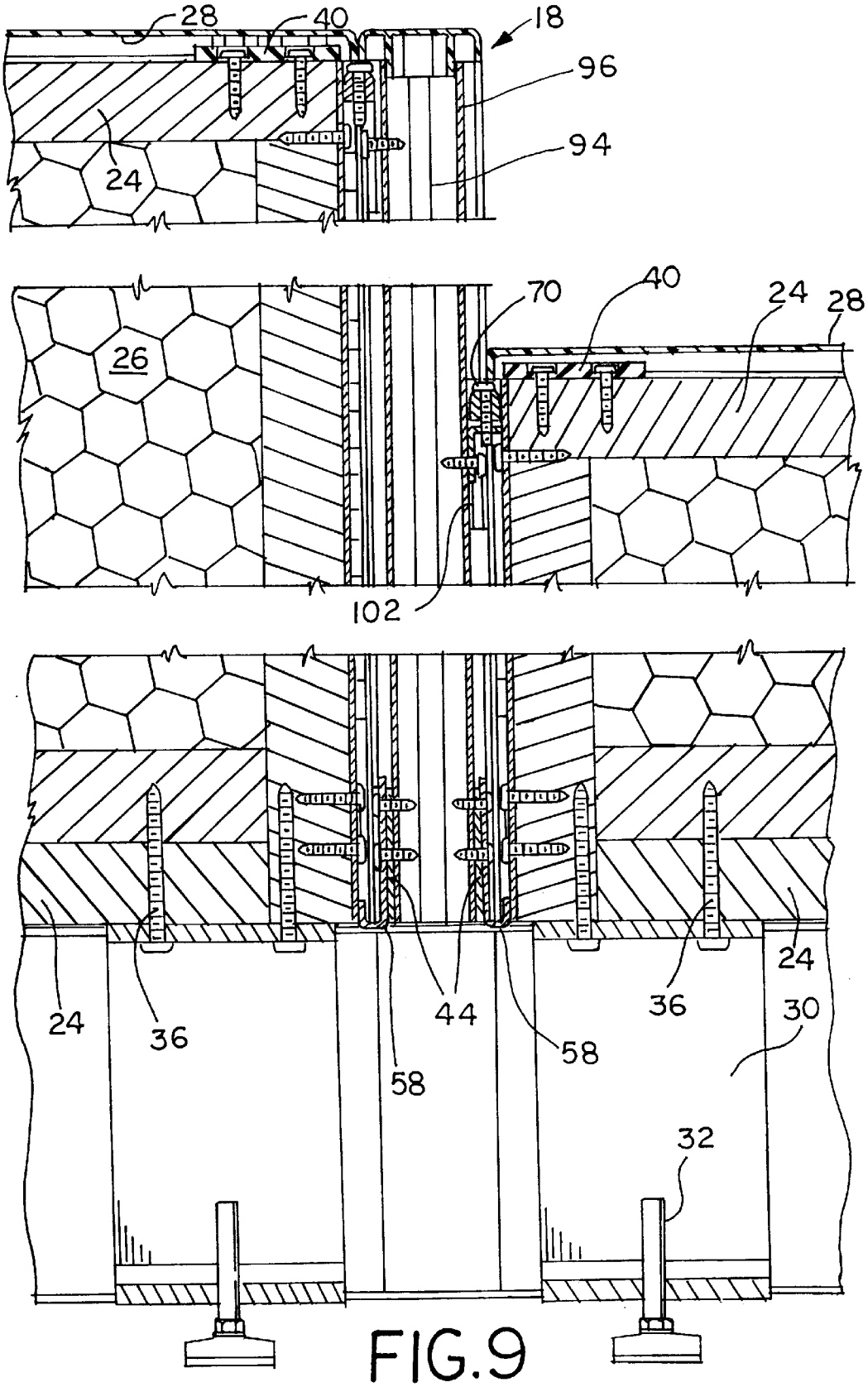
FIG. 9 is a fragmentary, cross-sectional view taken substantially along lines 9—9 of FIG. 1.

Referring now to FIGS. 3 and 8, the connection between the panel 16*a* and the post 18 and the panel 16*b* and the post 18 will now be described. Referring now to the post 18, post 18 has a substantially square tubular inner wall 94 defining four corners from which extend diagonal extensions 96. Contoured corners 98 are formed on the end of each of the extensions 96 and thus define grooves which both accept and retain either correspondingly configured trim pieces 100 or upper anchor 102 and lower anchor 104. The anchors 102 and 104 are configured in the same way as are the rails 44 attached to the ends of the panel members. Upper anchors 102 are secured to the corresponding side of the post 18 by screw fasteners. Angle brackets 90 may also be used with the post 18, or the upper anchors 102 may cooperate with rails 44 on the edges of the panel 16*a* to be joined thereto by upper connector 70, fasteners 80, and L-shaped brackets 84 in exactly the same way that panel 12*a* is joined to panel 12*b*. As discussed above, the bracket 90 and lower connector 58 may be installed either on the post 18, or on the edge of the panel joining with the post 18. As illustrated in FIG. 3, the panel 16*a* is provided with the L-shaped bracket 84, so that the upper connector 102 is not provided with an L-shaped bracket 84. However, the upper connector 102 mounted on the side of the post 18 that is to be secured to the panel 16*b* is equipped with an L-shaped bracket 90 so that the edge (not shown) of the panel 16*b* would be equipped only with a rail and not with bracket 90. Upper connectors 70 are in each case the same, and connect the post with the corresponding panels in exactly the same way that the upper connector 70 connects two panels together as described above. As also shown in FIG. 3, the panel 16*a* is provided with a lower connector 58, which engages with the rails 44 and particularly the flanges 48 thereof of a lower anchor generally indicated by the numeral 104. The anchor 104 that cooperates to panel 16*a* is not shown in FIG. 3 but is identical to the anchor 104 that is shown in FIG. 3 and which connects with the panel 16*b*. The lower anchors 104 are substantially identical to the upper anchors 102. The panels 16*a,* 16*b* are secured to the post 18 in the same way as the panels 12*a* and 12*b* are fastened together; that is, by first installing the flanges 48 of the lower anchor 104 in the groove defined by the lower connector 58, and then installing the upper connector 70 to draw the rails together and to maintain vertical alignment between the post and the panels. The panel 22 is connected to the post 18 in the same manner, except that the upper anchor 108 is installed in an appropriate lower position on the post and the portion of the post above is covered by appropriate trim strip. Referring now to FIGS. 1, 4, and 8, the manner in which panels of different height are joined, such as the panels 12*b* and 16*a,* will now be described. The panel 12*b* is equipped with a lower connector 58, which extends across the lower ends 66 of the flanges 48 of the rail 44 mounted on the vertical edge of the panel 12*b.* The lower ends 66 of the flanges 48 of the rail 44 mounted on the vertical edge of the panel 16*a* is received within the upwardly facing groove of the connector 58 in exactly the same manner as described above. The upper connector 70 and the bracket 84 are replaced, however, by a transition connector generally indicated by the numeral 106. Transition connector 106 includes an upper mounting tang 108 that is mounted flush on the outer surfaces of the flanges 48 that face the upper edge of the panel 16*a* by a screw fastener 110. An offset 112 extends from the tang 108, and extends over the upper edges 82 of the flanges 48 of the rail 44 mounted on the panel 16*a.* The edges of the portion 112 cooperate with the edges 50 of the rail 44 to align the panel 16*a* transversely with respect to the panel 12*b* in the engagement of the portion 112 with the upper edge 82 in cooperation with the lower connector 58 orients the panels vertically with respect to one another. The screw 110 extends through the tang 108 and into an aperture 114 in the rail 44. A narrower tang 116 extends from portion 112 and is offset back into the gap G between the flanges 48 of the rails 44 mounted on panels 12*b,* and 16*a.* The engagement of the lower tang 116 with the edges of the flanges 48 serves to maintain the transition connector 108 in proper transverse alignment, to thereby also align the panel 16*a* with the panel 12*b.* The portion of the rail 44 of the panel 12*b* above the top of the panel 16*a* is covered by an appropriate trim strip 118.

Accordingly, only 4 different pieces of hardware are required to install the space divider system in the field. These are the lower connector 58, the upper connector 70, the L-shaped bracket 84, and the transition connector 106. If these four pieces of hardware are available, the panels may be quickly installed in any desired configuration to subdivide building space. Because no intermediate member is required, and because the rails 44 are relatively thin, the upper and lower connectors can tighten the flanges of the rails tightly against one another, thereby minimizing the gap between panels that must be concealed by the arms 56 of trim strips 54.

What is claimed:

1. A space divider system comprising multiple interconnected panel members to form freestanding walls to subdivide an area, each of said members having a vertical edge, a pair of vertically extending rails, one of said rails being secured to the vertical edge of one of said members, the other rail being mounted on the vertical edge of an adjoining member to which the one member is to be secured, an upper connector securing said rails to one another, a lower connector mounted on one of said rails having vertically tapering legs defining an upwardly facing groove receiving said rails, said tapering legs urging said rails toward one another, and a pair of vertically extending flanges on each of said rails, said flanges of said rails being offset from the corresponding vertical edges to define a vertically extending pocket therebetween, each of said connectors extending from a pocket of one of said members and including a leg extending into the pocket of the other member, said upper connector including a bridging portion extending between said panel members and a pair of legs having diverging surfaces diverging outwardly from said bridging portion, said legs defining a downwardly facing groove, said groove receiving said rails, said rails engaging the diverging surfaces of said legs, each of said legs extending into a pocket of one of said rails.

2. Space divider system as claimed in claim 1, wherein a bracket is mounted on one of said members and includes an arm projecting toward the other member, and a fastener extending through an opening in said bridging portion and engaging said arm, whereby said fastener may be used to move the upper connector toward and away from the bracket.

3. A space divider system comprising multiple interconnected panel members to form freestanding walls to subdivide an area, each of said members having a vertical edge and an upper edge, said panel members including taller and shorter panel members in which the upper edge of a taller panel member is offset vertically from the upper edge of an adjoining shorter panel member, a pair of vertically extending rails having top and bottom ends, one of said rails being secured to the vertical edge of a taller panel member, the other rail being mounted on the vertical edge of an adjoining shorter panel member to which the taller panel member is to be secured, said one rail including a section extending above the upper edge of said shorter panel member, each of said rails defining a vertically extending pocket, a lower connector mounted on one of said rails and including a portion extending around the bottom end of the other rail and into the pocket of the other rail, and an upper connector secured to said section of said one rail extending above the upper edge of said shorter panel member, said upper connector member including a portion extending over the top end of the other rail and into the pocket of the other rail.

4. Space divider system as claimed in claim 3, wherein each of said rails include flanges facing flanges of the rails mounted on the other panel member, each of said flanges having outer surfaces, said upper connector includes a mounting tang secured to the taller panel member and an offset extending from said tang and into the pocket defined by the rail mounted on said shorter panel member.

5. Space divider system as claimed in claim 4, wherein said flanges of the rails mounted on said panels define a gap therebetween, said upper connector further including a tab projecting from said offset into the gap between the flanges of the rails mounted on the shorter panel member.

6. A space divider system comprising a panel member and an interconnect member, the panel member and the interconnect member each having a vertical edge, a pair of vertically extending rails, one of said rails being secured to the vertical edge of the panel member and the other rail being mounted on the vertical edge of the adjoining interconnect member, an upper connector and a lower connector each having vertically tapering legs defining a groove there between, the upper connector groove facing downwardly and the lower connector groove facing upwardly whereby both grooves engage said rails to urge said panel member and interconnect member together, a bracket mounted on one of said vertical edges, and a fastener adjustably connecting said upper connector to the bracket to permit said upper bracket to be moved toward an away from the lower connector.

7. The space divider system as claimed in claim 6, wherein the interconnection member is panel member.

8. The space divider system as claimed in claim 6, wherein the interconnection member is a post member.

9. The space divider system as claimed in claim 6, wherein each of said rails have offset flanges defining a vertically extending pocket there between, each of said connectors extending from said pocket of said rail secured to said panel member and including a leg extending into said opposing pocket of said other rail secured to the interconnection member.

10. The space divider system as claimed in claim 9 wherein each of the pockets includes side edges, said connectors cooperating with the side edges to orient the rails laterally with respect to one another.

11. The space divider system as claimed in claim 9 wherein each of said legs of said upper connector extend into a pocket of one of said rails.

12. A space divider system comprising a panel member interconnectable to a post member, said post member having four vertical faces, each said face including a receiving channel, a first rail being secured to a vertical side of said panel member, and a second rail member being slidably received within said channel of said post member, and a connector member securing said rails together.

13. The space divider system as claimed in claim 12, further comprising a trim piece snappably receivable within the receiving channel.

14. The space divider system as claimed in claim 12, wherein the receiving channels are defined by diagonal extensions with contoured corners extending from said post member.

15. The space divider system as claimed in claim 12, wherein the connector member includes an upper connector and a lower connector, each of said connectors having tapered legs defining a groove there between for receiving ends of said rails.

16. The space divider system as claimed in claim 15, wherein the connector member further includes a bracket mounted to the vertical side edge of said panel member and a fastener adjustably connecting the upper connector to the bracket to permit the upper connector to be moved toward and away from the lower connector.

17. The space divider system as claimed in claim 15, wherein the connector member further includes a bracket mounted to a face of said post member and a fastener adjustable connecting the upper connector to the bracket to permit the upper connector to be moved toward and away from the lower connector.

* * * * *

UNITED STATES PATENT AND TRADEMARK OFFICE

CERTIFICATE OF CORRECTION

PATENT NO. : 6,088,980

DATED : July 18, 2000

INVENTOR(S) : Barron J. Gulliver

It is certified that error appears in the above-identified patent and that said Letters Patent are hereby corrected as shown below:

Claim 6, Line 59, [an] -- and --

Signed and Sealed this

Twenty-second Day of May, 2001

*Attest:*

Nicholas P. Godici

NICHOLAS P. GODICI

*Attesting Officer*

*Acting Director of the United States Patent and Trademark Office*